United States Patent [19]

Otsuka

[11] Patent Number: 4,841,907

[45] Date of Patent: Jun. 27, 1989

[54] DEVICE FOR APPLYING GLUE TO A CUT END OF VENEER SHEET

[75] Inventor: Toshiyuki Otsuka, Obu, Japan

[73] Assignee: Meinan Machinery Works, Inc., Obu, Japan

[21] Appl. No.: 215,201

[22] Filed: Jul. 5, 1988

[30] Foreign Application Priority Data

Jul. 15, 1987 [JP] Japan ..... 62-109553[U]

[51] Int. Cl.[4] ..... B05C 11/00

[52] U.S. Cl. ..... 118/669; 118/106; 118/417; 118/680; 144/2 R; 144/346; 144/348; 156/258; 156/304.5; 156/558; 156/559; 427/284

[58] Field of Search ..... 156/258, 304 S, 558, 156/559, 304.6; 144/2 R, 345, 346, 348, 352, 356; 427/284; 118/37, 42, 106, 410, 669, 680

[56] References Cited

U.S. PATENT DOCUMENTS

| | | | |
|---|---|---|---|
| 3,445,313 | 5/1969 | Clausen et al. | 144/348 |
| 3,562,045 | 2/1971 | Hasegawa | 156/258 |
| 3,686,061 | 8/1972 | Brown | 156/258 |
| 3,781,107 | 12/1973 | Ruhland | 118/106 |
| 3,814,628 | 6/1974 | Larkin | 118/410 |

FOREIGN PATENT DOCUMENTS

| | | |
|---|---|---|
| 57-53302 | 3/1982 | Japan . |
| 62-16801 | 4/1987 | Japan . |

*Primary Examiner*—W. Donald Bray

*Attorney, Agent, or Firm*—Brooks Haidt Haffner & Delahunty

[57] ABSTRACT

A device for applying glue to the cut leading end of a veneer sheet which is applicable to use in a veneer jointing apparatus is disclosed herein. The device has hold-down means for holding the veneer sheet adjacent its cut leading end against a support surface on which a glue deposit is formed previously along a line across the veneer feeding direction, so that the end is straightened against said support surface at least while the glue is picked up by the cut surface on the moving leading end. It is so controlled that said holding means is shifted to its holding position before the cut leading end of the veneer sheet reaches the glue deposit and also that it is shifted away from the holding position only after the glue has been picked up by the cut leading end.

11 Claims, 7 Drawing Sheets

DEVICE FOR APPLYING GLUE TO A CUT END OF VENEER SHEET

FIELD OF THE INVENTION

The present invention relates to a device for applying glue to a cut leading end of a wood veneer sheet. More specifically, it relates to a device for applying glue to the end which is applicable to use in a veneer jointing apparatus for jointing such end with a similarly-cut trailing end of preceding veneer sheet.

BACKGROUND OF THE INVENTION

A device for applying glue to a cut surface on the leading end of each moving wood veneer sheet for subsequently jointing such end with a similarly-cut trailing end of preceding veneer sheet is disclosed by Publication of Examined Japanese Patent Application No. 62-16801 (1987). This device includes a conveyer for feeding veneer sheets successively, an intermittently rotatable endless belt provided midway of the feed conveyer and extending perpendicularly with respect to the direction of veneer feeding with the outer surface of its upper run positioned substantially level with the plane in which the veneer sheets are advanced by the conveyer, and a glue supply located adjacent the upstream end of the upper run of the above intermittently movable belt for depositing glue onto said belt while it is being moved so that either a continuous line or a series of individual spots of glue may be formed on the outer surface of the upper run of the belt. Application or coating of glue to the cut end in this device is accomplished by feeding the veneer sheet with its leading end moved against the glue deposit extending in parallel relation to the line defined by the end, thus the glue being picked up by and attached to the leading end. The device according to the above Publication is adapted to use for jointing veneer sheets in side-to-side relation to each other, or jointing the sheets along a line parallel to the fiber orientation of wood veneer sheet, and, therefore, each veneer sheet is moved by the conveyer with its fiber orientation directed in transverse relation to the direction in which the sheet is moved.

With such a device, however, satisfactory uniformity in the glue application can be accomplished only if the leading end of the veneer sheet is maintained straight at least when that end is moved past the glue deposit on the belt to pick up the glue by scooping. To be more specific, moving a veneer sheet having a waved leading end against the glue deposit on a flat surface will result in poor partial application of the glue to the end.

In view of the characteristic of veneer sheet produced, e.g., by peeling that it tends to be curled or so bent that its longitudinal ends become wavy, the above device is unable to apply glue uniformly over the cut surface on such longitudinal ends. Additionally, since the strength of a wood veneer sheet is generally much lower in the direction along its fiber orientation than it is in the direction thereacross, poor glue application will, as would be understood by those skilled in the art, affect the overall strength of a veneer sheet having therein a joint specifically formed by the longitudinal ends of two veneer sheets.

SUMMARY OF THE INVENTION

Therefore, it is an object of the present invention to provide a device for applying glue to a cut end of veneer sheet applicable to use in a veneer jointing apparatus, which can ensure uniformity in glue application to the surface of the cut end, thereby making possible availability of jointed veneer sheet having satisfactory joint strength.

In the device according to the present invention, a support member is provided which has a support surface spaced away from a plane which is defined by a veneer sheet for supporting the leading end portion of the veneer sheet, and glue feed means is provided which is adapted to feed glue onto the support surface of the support member in such a way that glue deposit may be formed on the support surface along a line substantially perpendicular to the direction of veneer feeding, whereby the glue may be applied to a cut leading end of the veneer sheet by moving the sheet in feeding direction against the glue deposit on the support surface so that the cut leading end may pick up the glue deposit by scooping. The device of the invention includes holding means which is disposed opposite to the support surface with respect to the plane of veneer feeding and has a surface for holding the veneer sheet adjacent its cut leading end against the support surface. The holding means is shiftable between its inoperative position where the holding surface is placed away from the support surface and the operative position where it is placed in pressing contact with the veneer sheet adjacent the cut leading end so as to hold-down the leading end portion against the support surface.

The device further includes means for monitoring the movement of the veneer sheet in the above direction, means for shifting the holding means between its inoperative and operative positions, and control means connected to the monitor means and shifting means for controlling the operation of the shifting means according to a position reached by the cut leading end of the veneer sheet which is detected by the monitor means. The control means is operable on the shifting means in such a way that the holding means is shifted to its operative position before the cut leading end of the veneer sheet reaches the glue deposit and also that it is shifted from its operative position toward the inoperative position only after the glue has been scooped up by the cut leading end.

In order to allow the veneer sheet to move forward smoothly while being held down, the holding means may be provided advantageously by a freely rotatable roll having a peripheral surface for the above pressing surface and shiftable between the inoperative position where the peripheral surface is placed away from the support surface and the operative position where it is placed in pressing contact with the veneer sheet adjacent the cut leading end against the support surface.

The device according to the invention may further include glue spreading mean which is disposed downstream of the holding means and has a glue spreading portion engageable with the support surface of the support member for spreading the glue picked up by the leading end over the cut leading end. Such spreading means can be advantageously used in handling veneer sheets each having a beveled leading end. The glue spreading means is shiftable between the inoperative position where the spreading portion is placed away from the support surface and the operative position where it is placed at least firstly in engagement with the support surface for spreading the glue over the beveled surface on the leading end when it moves past the glue spreading portion.

In the above arrangement of the device, holding down the veneer sheet adjacent its cut leading end causes the leading end portion of the sheet to be deformed flat because the support surface of the support member is spaced away from the veneer feeding plane. Therefore, the cut end of the sheet is straightened against the support surface and the glue can be applied uniformly to the cut end by maintaining the held-down state of the leading end portion at least while the cut leading end picks up the glue.

The above and other objects, features and advantages of the invention will become apparent to those skilled in the art from the following description of a preferred embodiment of veneer handling apparatus according to the present invention, which description is made with reference to the accompanying drawing, wherein:

DETAILED DESCRIPTION OF THE PREFERRED EMBODIMENT

Figure 1:
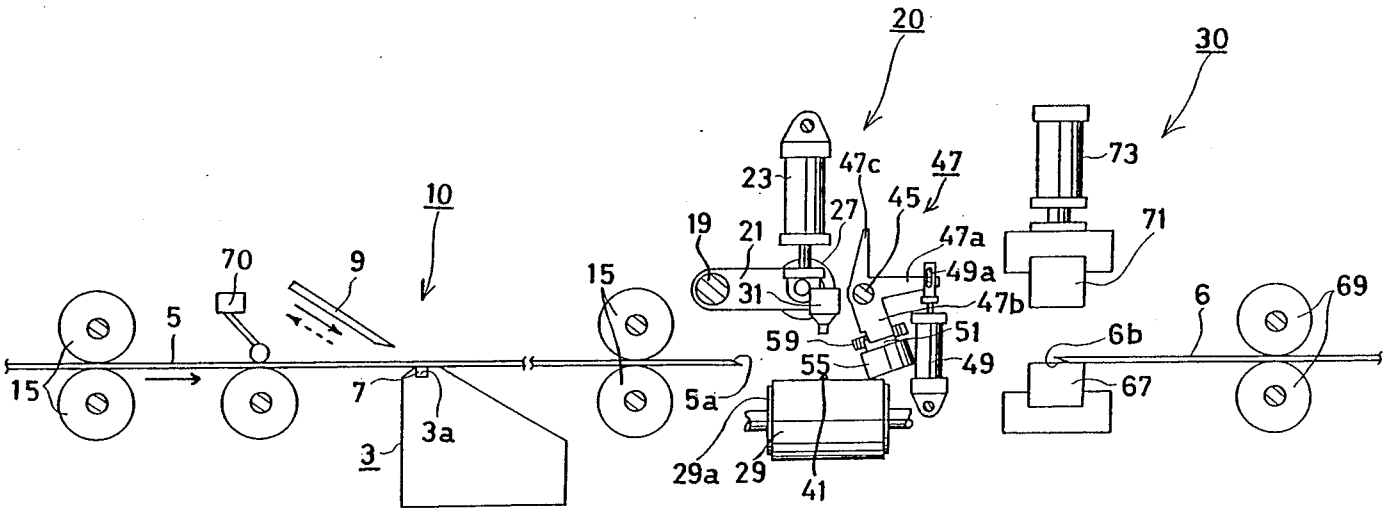
FIG. 1 is a schematic side view showing a preferred embodiment of device of the invention for applying glue to a cut leading end of a veneer sheet as used in a veneer jointing apparatus including a clipper and a jointing press.
Figure 2:
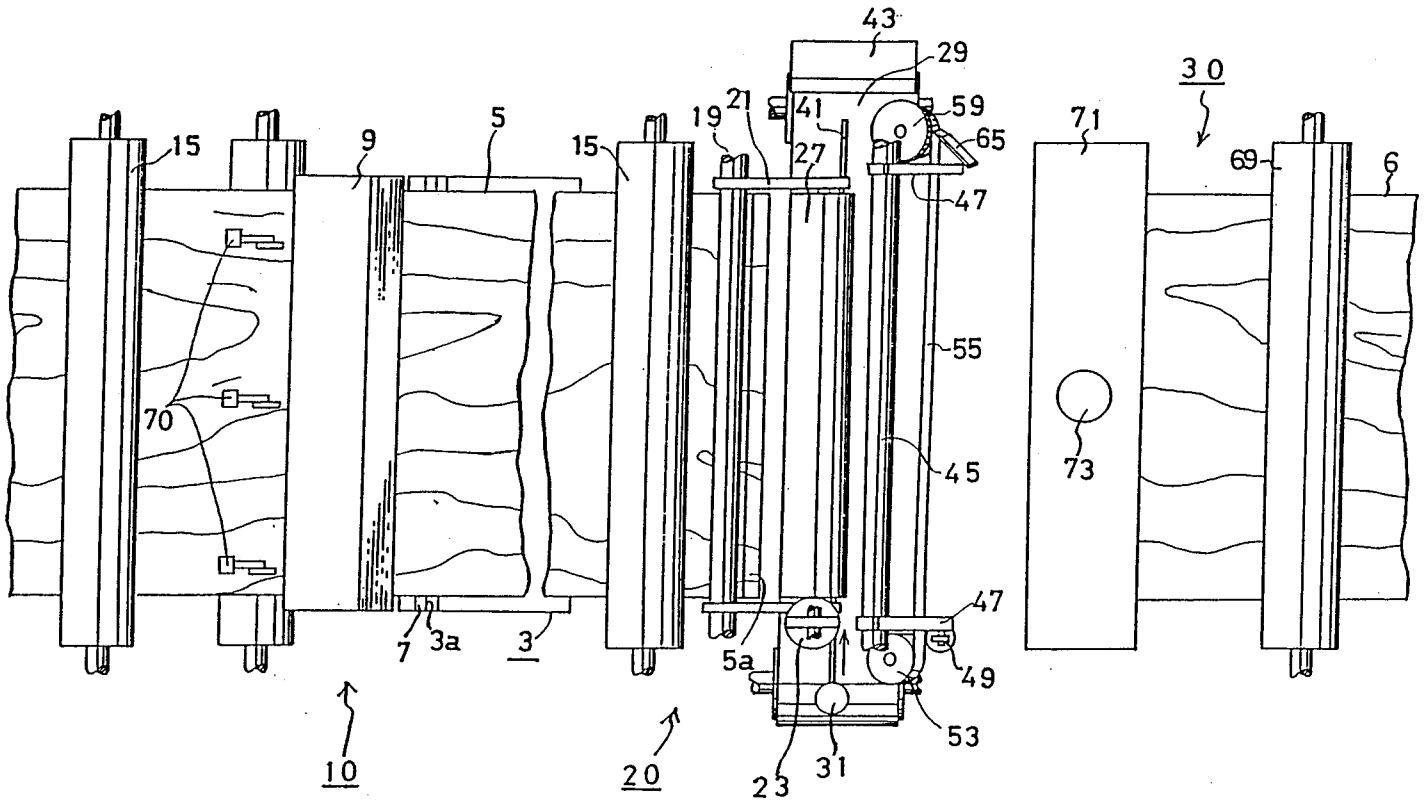
FIG. 2 is a plan view of the veneer jointing apparatus of FIG. 1.

Referring to FIGS. 1 and 2, the veneer jointing apparatus has three working stations for veneer clipping for defect removal, glue applying to the surface on the clipped leading end of each veneer sheet, and pressing the mating ends of two successive veneer sheets for jointing, and these stations are designated generally by the reference numerals 10, 20 and 30, respectively. The clipping station 10 includes two pairs of rolls 15, 15 for feeding a veneer sheet, e.g. 5, forward in the arrow direction. The pairs of feed rolls 15 are connected to a drive motor (not shown) by way of a clutch (not shown either) which is in turn connected a control 80, as indicated in FIG. 4, and operable intermittently in response to an electrical signal transmitted from the control.

A veneer clipper is disposed between the pairs of feeding rolls 15, comprising a reciprocally movable knife 9 having its cutting edge extended across the width of the veneer sheet 5 and an anvil block 3 extending in the same direction as the knife cutting edge. It is noted that the above width of the veneer sheet 5 (6) is defined herein as the dimension thereof as measured transversely with respect to the direction in which the sheet is fed along its fiber orientation as shown by the grain pattern in FIG. 2. The clipper knife 9 is provided at a predetermined inclination with reference to a horizontal plane defined by the veneer sheet 5 being moved by the feed rolls 15 and driven reciprocally as indicated by two arrows to move toward and away from the anvil block 3 for cutting off normally irregularly shaped leading and trailing end portions of each incoming veneer sheet. The anvil block 3 has a groove 3*a* formed in its top and having therein a resilient member 7 made of, e.g., urethane rubber for receiving the edge of the knife 9 in its cutting stroke.

Figure 4:
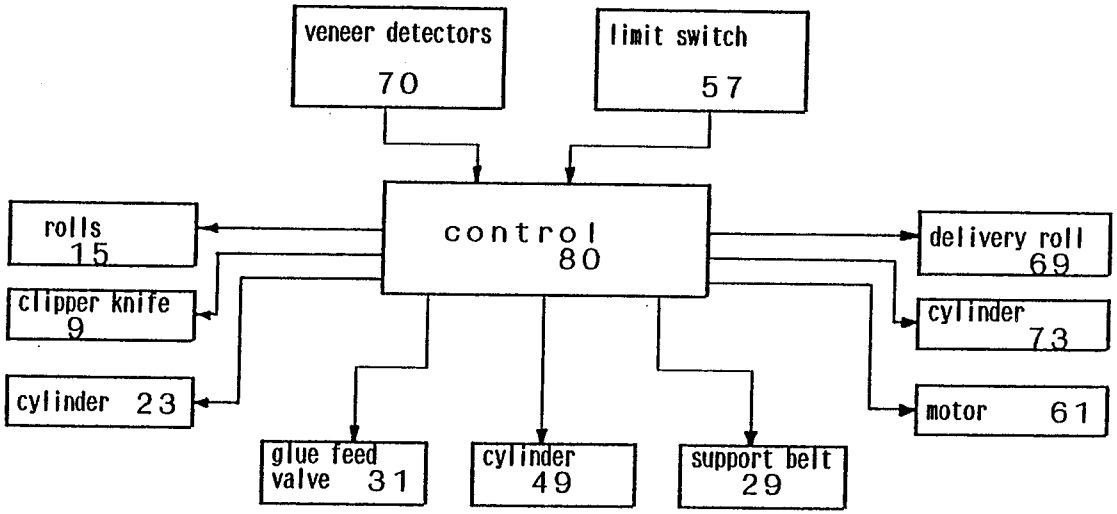
FIG. 4 is a simplified block diagram showing an example of electrical control system in the jointing apparatus of FIG. 1.

The clipper knife 9 is connected to the control 80, as indicated in FIG. 4, and activated to make each cut in response to a control signal that the control generates according to detect signals from a plurality of veneer detectors 70 which are also connected to the control and located, as shown in FIGS. 1 and 2, adjacent and upstream of the knife and spaced at an appropriate interval along a line transverse of the veneer sheet feeding direction for locating the position or line on the veneer sheet 5 at which a cut is to be made by the knife for removing it normally irregularly shaped leading and trailing end portions with the minimum waste of usable portion of the veneer sheet. For the detailed information on the construction and operation of such veneer detectors, U.S. Pat. Nos. 3,477,327 and 4,510,009 may be consulted.

In the illustrated arrangement wherein the knife 9 is reciprocated at an angle of the predetermined inclination, the veneer sheet after removal of its end irregularities will have scarved or beveled leading and trailing ends, as indicated by 5*a* of the veneer sheet 4 and 6*b* of the sheet 6, having the above angle of inclination. As shown clearly in FIG. 1, each veneer sheet is fed with the beveled surface on the leading end 5*a* facing upward. Though not shown in the drawings, a clamp device is provided above and downstream of the clipper knife 9, operable in synchronism with the cutting motion of the knife 9 so that the irregularly shaped leading end portion of veneer sheet may be clamped down when that end portion is being cut off from the sheet and also that a portion of the veneer sheet just ahead of the irregularly shaped trailing end portion is held down when that trailing end portion is being cut off for defect removal. Since the manners of cutting operation to form beveled ends and of discharging cut-off end portions are described in the Publication of Unexamined Japanese Patent Application No. 57-53302 (1982), the detailed explanation on the construction and operation of the knife 9 are herein omitted.

The control 80 has incorporated therein a rotary encoder (not shown) for counting the respective distances moved the cut leading and trailing ends, e.g. 5*a* and 6*b*, for allowing the control to generate signals at appropriate times for controlling the actuation of various operating parts provided in the respective working stations, as will be explained.

Downstream of the veneer clipper is the station 20 for applying glue to the beveled leading end, e.g., 5*a* of the veneer sheet 5. The glue application device includes a freely rotatable hold-down roll 27 having its axis extended across the direction in which the veneer sheet 5 is advanced by the feed rolls 15. The hold-down roll 27 is rotatably supported at its opposite ends by swing arms 21 which are in turn mounted on a support shaft 19. There is provided an air-operated cylinder 23 having its piston rod connected to the swing arm 21 on one side of the hold-down roll 27. As shown in FIG. 4, the cylinder 23 is operatively connected to the control 80 and actuated from a control signal therefrom substantially in synchronism with the movement of the beveled leading end 5*a* just below the hold-down roll 27, or with a delay of time after each cut of the leading end, e.g. 5*a*, and before it reaches just below the roll 27, the distance moved by the end during that time being counted by the rotary encoder in the control 80. The cylinder 23 thus actuated causes the arms 21 to swing from its dash-anddot-line position (FIG. 5) down to its solid-line position, thereby moving the hold-down roll 27 from its inoperative position down to its operative position where its lowermost peripheral portion is slightly below the aforementioned veneer feeding plane for holding down the veneer sheet 5 adjacent its beveled leading end 5*a* against a veneer sheet support belt 29 which will be described below.

The support belt 29 is made of a flexible metal formed in a loop trained around and between a pair of pulley members 29*a* and disposed just below the hold-down roll 27 with the outer surface of its upper run of the loop located slightly below the aforementioned veneer feeding plane for supporting the leading end portion of the veneer sheet when it is held down by the hold-down roll. The support belt 29 is movable intermittently in the arrow direction (FIG. 2) parallel to the axis of the hold-down roll 27. To move the belt 29 intermittently, it is operatively connected to an electric motor (not shown) by way of a clutch (not shown either) which is in turn connected to the control 80 (FIG. 4). The clutch is engageable in response to a control signal from the control 80, thereby transmitting the power from the motor to the belt 29, substantially synchronously with the operating motion of the clipper knife 9 to make a cut for the trailing end, e.g. 6*b* of the veneer sheet 6. It is so controlled that the clutch is engaged for a predetermined period of time that corresponds to about a half turn of the support belt 29 that causes its upper and lower runs of the loop to be just reversed.

Figure 3:
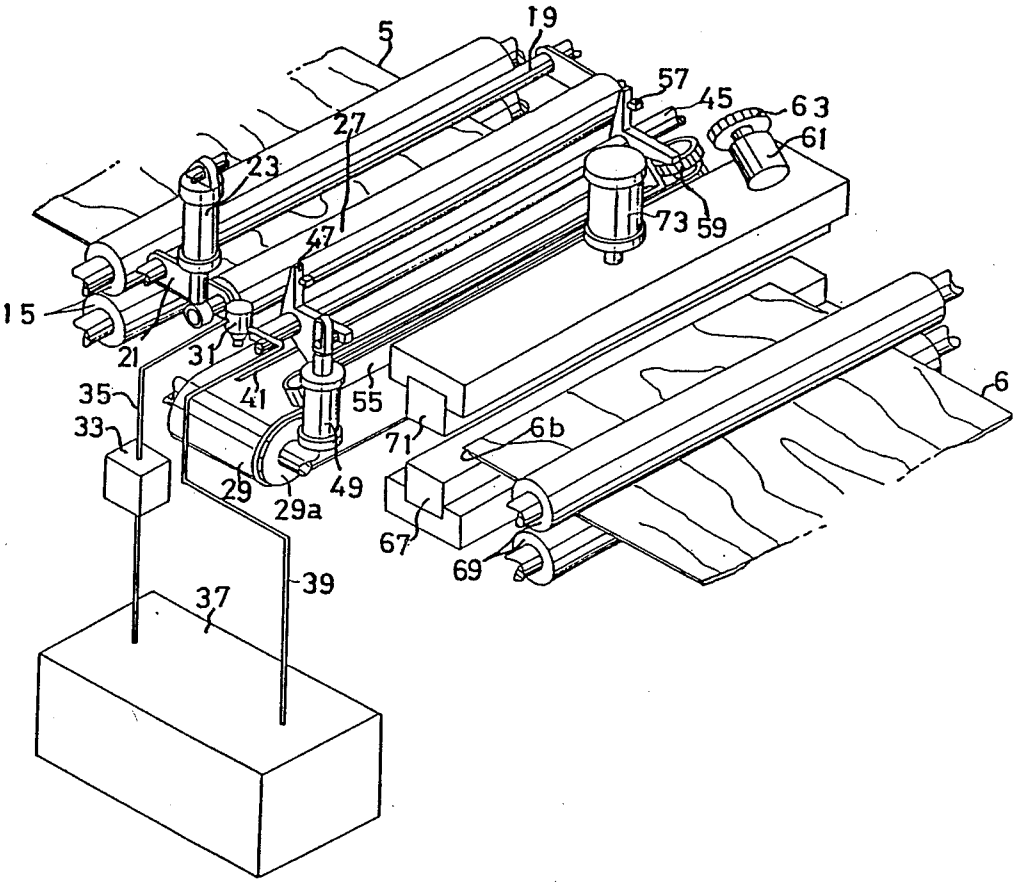
FIG. 3 is a perspective partial view of the veneer jointing apparatus of FIG. 1.

Adjacent the upstream end of the upper run of the loop of the support belt 29 is located a glue feed valve 31 having, as shown in FIG. 3, on one hand a feed pipe 35 connected to a glue reservoir 37 via a feed pump 33 and on the other a return pipe 39 leading to the glue reservoir 37. The reservoir 37 contains glue which is drawn by the pump 33 and moved through the feed pipe 35 to the glue feed valve 31 which, when actuated to open, allows the glue to be fed onto the support belt 29. The feed valve 31 is also connected to the control 80 (FIG. 4) and actuated from a signal therefrom to be opened in conjunction with the half-turn movement of the support belt 29 for forming a line of glue deposit 41 on the outer surface of the upper run of the support belt substantially transversely with respect to the veneer sheet feeding direction so that the glue 41 on the belt may be scooped up by the beveled surface on the advancing leading end 5*a* of the veneer sheet 5. Excess glue or glue pumped while the feed valve 31 is closed is returned to the reservoir 37 through the return pipe 39.

As the glue for use in the apparatus, a water soluble, thermosetting glue is suitable which can offer long usable time and be quickly set or cured by the application of heat and pressure. For example, urea resin, melamine resin, etc., are desirable for the purpose.

As shown in FIG. 2, a blade 43 is provided adjacent the downstream end of the support belt 29 with its edge placed in pressing contact with the outer surface of the support belt for removing or scraping off the residual glue on the belt.

Above the support belt 29 and adjacent the hold-down roll 27 is mounted a freely rotatable shaft 45 extending with its axis in parallel to that of the roll 27. The shaft 45 has on each end thereof a glue spreader carrier 47 in the form of a rotatable three-armed member having three arms 47*a*, 47*b* and 47*c* each extending radially from the shaft. The first arm 47*a* is connected to an air-operated cylinder 49 by way of a pin projecting on the arm 47*a* and received an elongated hole 49*a* formed in the end of piston rod of the cylinder 49 for allowing the carrier 47 to rotate slightly in counter-clockwise direction as viewed in FIG. 1. The cylinder 49 is connected to the control 80 (FIG. 4) and operated to shift a glue spreader belt 55, which will be described below, from its normal elevated position to its operative position where it is in contact engagement with the upper surface of the support belt 29, substantially in synchronism with the downward shifting movement of the hold-down roll 27 in response to a control signal from the control.

The second arms 47*b* of the carrier 47 has the above glue spreader belt 55 which is in the form of an endless loop trained between pulleys 53 (only one being shown in FIG. 2) rotatably supported by a back-up member 51 (shown clearly in FIG. 5) which is in turn mounted between the arms 47*b* within the loop of the belt 55. The glue spreader belt 55 is made by a resiliently deformable material such as metal for spreading the glue scooped up by the leading end 5*a* of veneer sheet 5 over its beveled surface when the end is moved past the flexible lower edge of the belt 55 with the hold-down roll 27 then shifted in its operative position to hold down the veneer sheet. The back-up member 51 is made of a rigid material and arranged so as to hold or back up the belt 55 from behind. As shown clearly, e.g., in FIG. 7, the back-up member 51 is shaped to provide a non-backing space 54 so that the lower edge portion of the glue spreading belt 55 may be allowed to be resiliently deformed by contact thereof with the beveled end 5*a* moving past the spreading belt 55. One pulley 53 on the second arm 47*b* located adjacent the downstream end of the upper run of the belt 29 has a first gear 59 mounted on the shaft on which that pulley is mounted. There is provided a second gear 63 (FIGS. 3, 5, 6, 7) operatively connected to an electric motor 61 and located in such a position that the first gear 59 may be brought into engagement therewith when the glue spreader carrier 47 is rotated as far as it will go in clockwise direction as viewed, e.g., in FIG. 5 to cause the spreading belt 55 to move away from the support belt 29. The motor 61 is connected to the control 80, as shown in FIG. 4, and operable in response to a control signal transmitted from the control at such a time that the motor may be energized upon the engagement of the gears 59, 63. To permit such time controlling, the control 80 is connected to switch means 57 which will be explained below. It is so arranged that the motor 61 is rotated for a predetermined period of time which causes the belt 55 to rotate a half turn.

The switch means, e.g., a limit switch 57 is fixedly mounted to a frame (not shown) of the apparatus adjacently to the third arm 47*c* of the glue spreader carrier 47. It is normally in OFF state and adapted to be turned ON by contact thereof with the third arm 47*c* when the carrier 47 is rotated to cause the spreader belt 55 to contact at its lower edge with the surface of the support belt 29. The limit switch 57 can be turned OFF when the carrier 47 is rotated slightly by the glue spreading belt 55 which is raised by riding on the flat surface of the veneer sheet 5 after its relative movement over the beveled surface on the leading end 5*a*. The switch 57 generates an electrical signal due to such change from ON to OFF, in response to which the control 80 transmits a signal to operate the cylinder 23 so as to shift the hold-down roll 27 away from the support belt 29 to its inoperative position, with simultaneous operation of the cylinder 49 to rotate the carrier 47 in the direction to shift the glue spreader belt 55 upwards until the first gear 59 engages with the second gear 63. The motor 61 is then energized from a signal from the control 80 with an appropriate delay of time to be rotated for the predetermined period of time as described earlier.

As shown in FIG. 2, a blade 65 is provided adjacently to the pulley 53 carrying the first gear 59 in pressing contact with the outer surface of the glue spreading belt 55 for removing residual glue attached on the belt surface.

The pressing station 30 includes a stationary support block 67 extending at a level substantially corresponding to the aforementioned plane of veneer feeding, a vertically movable heating block 71 disposed just above the support block and supported by an air-operated cylinder 73. The heating block 71 has incorporated therein a heater (not shown) for heating the block to a level of temperature enough to cure the glue 41. The pressing station 30 further includes a pair of upper and lower delivery rolls 69 disposed at the downstream end of the station for delivering a jointed veneer sheet, e.g. 6, to the subsequent process.

The pair of delivery rolls 69 is connected to an electrical motor (not shown) through a clutch (not shown either) which is in turn connected to the control 80. The clutch is disengageable to interrupt the power transmission to the rolls 69 in response to a signal from the control 80 representing that the beveled trailing end, e.g. **6*b* of veneer sheet 6 has reached the support block 67 as shown in FIG. 1. On the other hand, the operation of the feed rolls 15 is stopped when the beveled leading end 5*a* of succeeding veneer sheet 5 has reached the support block 67 and brought into engagement with the trailing end 6*b* then resting on the same block. The cylinder 73 is also connected to the control 80 so as to be actuated in response to a signal therefrom to lower its heating block 71 upon a stop of the feed rolls 15 so that the ends 5*a* and 6*b* mated in a scarf joint may be pressed by the heating block 71 for a predetermined period of time while being subjected to heat. The operation of the feed rolls 15 and the delivery rolls 69** is resumed with a short delay after the elapse of the above period of time.

Though not shown in the drawings, the pressing station 30 is followed by, e.g., a station for continuously clipping the jointed veneer sheet 6 into sheets each having a format size of predetermined lengthwise and widthwise dimensions.

The operation of the veneer jointing apparatus thus constructed will be described in the following with reference to FIGS. 1, 4, 5, 6 and 7.

A veneer sheet having normally irregularly shaped portions on opposite ends is fed toward the veneer clipper by the feed rolls 15. As the veneer detectors 70 locates the line on the veneer sheet along which it should be clipped for removal of the leading end irregularity, the knife 9 is set into motion according to a signal from the control 80 with an appropriate delay of time so that a cut is made by the knife along that line for removal of the leading end irregularity. Thus, the veneer sheet 5 is formed at its leading end portion with a beveled end **5*a* having the predetermined angle of inclination. Though not shown in the drawings, the clamp device is operated synchronously with the cutting motion of the knife 9** to press down the veneer sheet to avoid its movement during cutting.

The veneer sheet 5 thus having a beveled end **5*a* is moved toward the glue applying station 20 by continued rotation of the feed rolls 15. As the beveled leading end 5*a* reaches the support belt 29 just below the hold-down roll 27, its cylinder 23 is actuated from a signal from the control 80 to shift the hold-down roll down to its operative position, where the leading end portion of the veneer sheet 5 is held down against the support belt 29, as shown in FIG. 4, to be flattened straight so that it may be moved forward while being kept in contact with the upper surface of the support belt 29**.

It is noted that the support belt 29 had already been moved for a half turn with simultaneous opening of the glue feed valve 31 when the trailing end **6*b* of the preceding veneer sheet 6 had been cut. Therefore, a line of fresh glue 41 has been already formed on the outer surface of the upper run of the belt 29 before the above leading end 5*a* of the succeeding veneer sheet 5 reaches the belt 29**.

Figure 5:
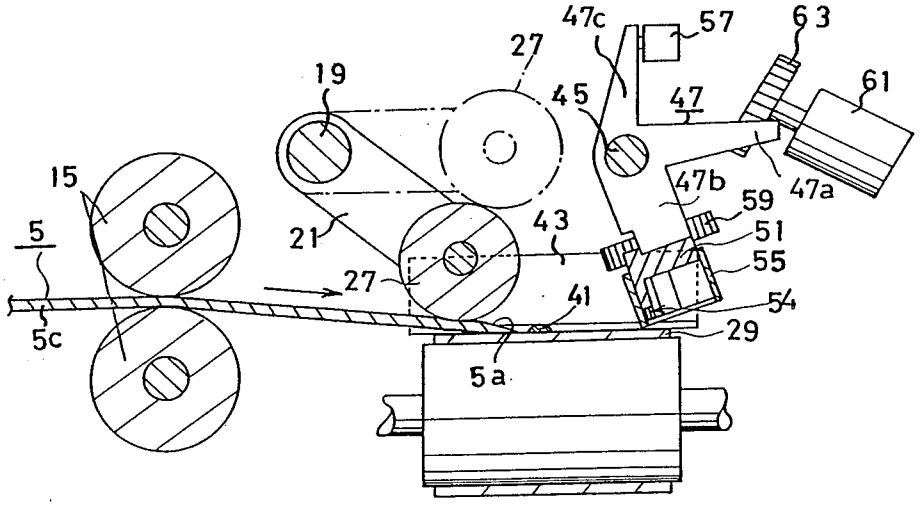
FIGS. 5 to 7 are illustrative view showing three different steps in glue application in the device of the present invention.
Figure 6:
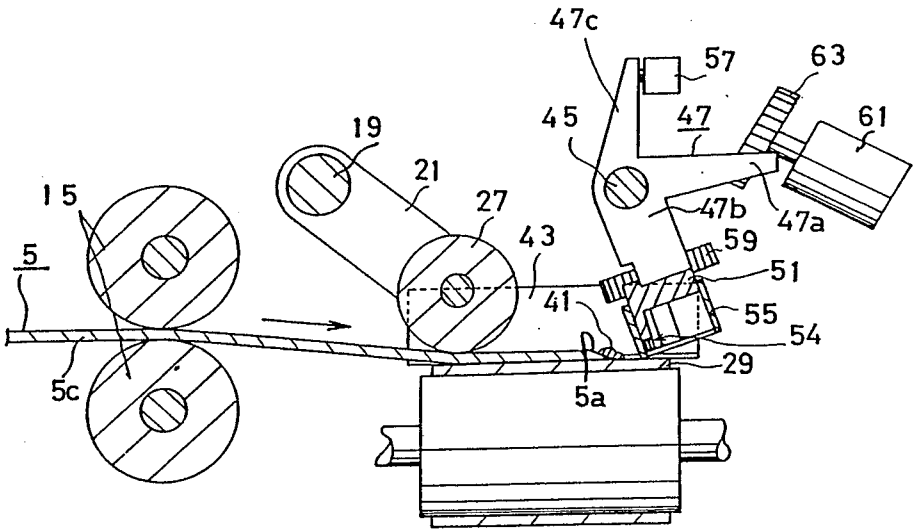
Figure 7:
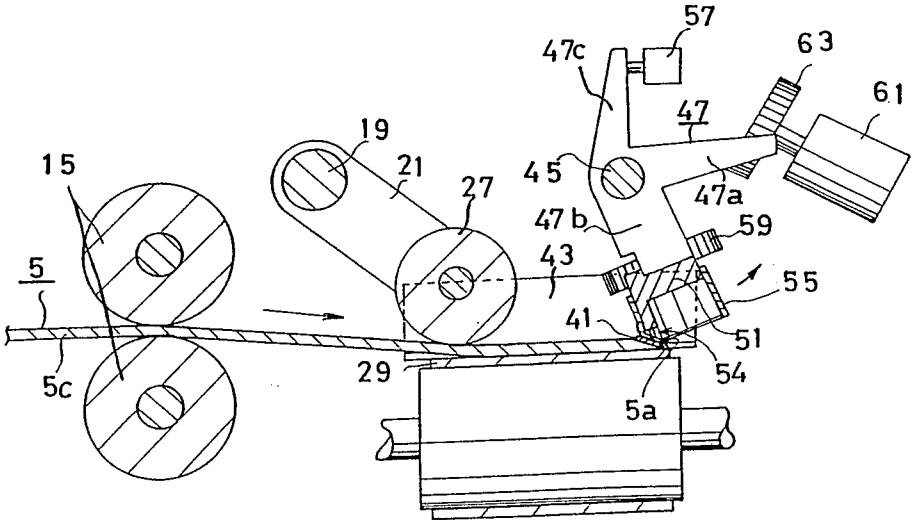

Substantially simultaneously with the operation of the above cylinder 23 to shift down the hold-down roll 27, the cylinder 49 is also operated to cause the glue spreader carrier 47 to be turned in clockwise direction until the lower edge of the glue spreader belt 55 is brought in contact with the outer surface of the support belt 29, as shown in FIG. 5. As the veneer sheet 5 is further moved forward, the glue 41 deposited on the belt 29 is scooped up by its leading end **5*a* (FIG. 6) and then coated and spread over the entire beveled surface on that end by the lower edge portion of the glue spreader belt 55 (FIG. 7). Because the belt 55 is resilient, its lower edge portion having no backing effect from behind is deformed according to the inclination of the beveled end 5*a* and presses it to spread the glue 41 uniformly over its beveled surface. Excess glue is scraped off from the beveled surface by the spreading belt 55**.

Further movement of the veneer sheet 5 causes the lower edge of the glue spreader belt 55 to ride on the flat surface portion of the sheet and the carrier 47 is thereby turned slightly in counter-clockwise direction with the pin on the second arm **47*b* moved in the elongated hole 49*a* in the piston rod end of the cylinder 49. As a result, the limit switch 57 is released from contact with the third arm 47*c* to be turned OFF. Responding to the change from ON to OFF of the limit switch 57, the control 80 actuates the cylinder 49 in the direction to shift the glue spreader belt 55 away from the veneer sheet 5 on the support belt 29. In this way, excess glue on the spreading belt 55 is prevented from being attached to the flat surfaces of the veneer sheet 5. The glue spreader carrier 47 is moved until the first gear 59 movable therewith is engaged with the second gear 63 which is connected to the motor 61. Upon the engagement, the motor 61 is operated to drive the glue spreader belt 55 through the gears 63, 59 for a half-turn movement. Glue remaining on the belt 55 is removed by the blade 43** during the half-turn movement of the belt.

The cylinder 23 is operated to return the hold-down roll 27 to its upper inoperative position in conjunction with the operation of the cylinder 49 to elevate the glue spreader carrier 47 return the hold-down roll 27 to its upper inoperative position.

When the leading end **5*a* coated with the glue on its beveled surface of the veneer sheet 5 reaches the support block 67 in the pressing station 30 and is brought into a scarf-joint engagement with the trailing end 6*b* of the preceding veneer sheet 6 then resting on the same support block, the rotation of the rolls 15 is stopped to interrupt the feeding motion of the veneer sheet 5. Upon stopping of the rolls 15, the cylinder 73 is operated to lower its heating member 71 against the veneer sheets for pressing the their scarf joint while applying heat thereto. After an elapse of the predetermined period of time enough to set the glue, the heating member 71 is raised by the cylinder 73, which is followed by resumption of rotation of the feed rolls 15 and the delivery rolls 69** to transfer the jointed veneer sheet to the next station, e.g., for continuously cutting the jointed veneer sheet into a predetermined length for producing sheets each having a format size.

When the aforementioned veneer detectors 70 locates the position on the veneer sheet 5 for cutting off its trailing end irregularity during transferring the jointed sheet, the clipper knife 9 is activated with the appropriate delay of time to make a cut so as to form a beveled trailing end similar to the end **6*b* of the preceding veneer sheet 6. In conjunction with the above clipper operation, the support belt 29 is driven to move for a half turn and the glue feed valve 31** is opened while the belt is being thus moved, thereby forming another line of fresh glue on the upper surface of the support belt.

By repeating a series of the above operations, each veneer sheet is clipped to have a straight cut leading end with simultaneous defect removal, glue is then applied substantially uniformly to the cut surface on the leading end, and such glue coated end is jointed with the similarly cut trailing end of a preceding veneer sheet, thus jointed veneer sheet having a satisfactorily tight joint being produced in a continuous manner.

It is to be understood that the above-described preferred embodiment of the invention can be changed or modified in various other ways, as exemplified in the following.

While, in the illustrated embodiment, various shifting and driving means such as cylinders and motors are operated at a right time according to the signals from the control 80 which operates by monitoring by its built-in rotary encoder the movement of the veneer sheet with reference to the position defined by the veneer detectors 70 and also responding to the operation of the limit switch 57, the rotary encoder and the limit switch may be replaced with individual detectors or sensors of any suitable type arranged at locations where passage of a veneer sheet end should be detected.

As the glue for jointing the veneer sheets, thermoplastic adhesive, e.g. hotmelt glue, which melts by heat and is set or cured by cooling may be employed in place of the thermosetting adhesive, in which case the heating member 71 in the jointing station 30 must be replaced with a cooling member. If an adhesive of high viscosity is used, it may be deposited on the outer surface of the lower run of a support belt which is similar to the belt 29 in the illustrated embodiment, but disposed with the above outer surface spaced away and above the veneer feeding plane. Accordingly, the hold-down and the glue spreader are provided below the veneer feeding plane and so arranged that their roll and belt may be moved toward and away from the lower surface of the support belt on which the glue is to be formed. Additionally, the knife in the clipping station must be set in such a position that produces a beveled surface on the leading end cut which faces outward with respect to the surface of the support belt so as to permit the glue to be scooped up by the cut end.

The glue deposit may be formed in other ways than that shown in the drawings. For example, the movable support belt 29 may be replaced with a stationary block and the glue feed valve 31 is replaced with either a plurality of glue injectors spaced along the block or a single glue injector movable therealong so that a glue deposit may be formed on the upper surface of the block along a line across the veneer feeding direction.

Though, in the preferred embodiment, the intermittently movable support belt 29 is driven to move for a predetermined distance in response to a signal representing that a cut is made by the clipper for forming the trailing end of a veneer sheet, it may be driven at any other convenient time, e.g., when the leading end of succeeding veneer sheet is clipped.

It must be noted that the present invention is not limited by the presence of glue spreading means such as the glue spreading belt 55 shown in the drawings. As it would be understood by those skilled in the art, the glue picked up by the cut leading end of a veneer sheet can be spread substantially satisfactorily over the cut surface by engagement of its end with the mating trailing cut end of the succeeding veneer sheet.

Additionally, the cylinder 23 may be connected directly to the hold-down roll 27 at one of its bearings supporting the roll at its axial ends, thus dispensing with the swing arm 21 and the support shaft 19. Furthermore, the cylinder 49 for operating to rotate the three-armed glue spreader carrier 47 may be replaced with cam mechanism connected to an electric motor.

What is claimed is:

1. A device for applying glue to a cut leading end of a sheet of wood veneer, comprising means for feeding said veneer sheet in a given direction through said device, a support member having a support surface thereof spaced away from a plane which is defined by said veneer sheet being fed for supporting the leading end portion of the veneer sheet, glue feed means for feeding glue onto said support surface of said support member in such a way that glue deposit may be formed on said support surface along a line substantially perpendicular to said given direction, whereby the glue may be applied to said cut leading end of the veneer sheet by moving the veneer sheet in said given direction against said glue deposit on said support surface so that said cut leading end may pick up the glue deposit, means disposed opposite to said support surface with respect to said plane of veneer feeding and having a surface for holding the veneer sheet adjacent its cut leading end against said support surface, said holding means being shiftable between inoperative position thereof where said holding surface is placed away from said support surface and operative position where it is placed in pressing contact with the veneer sheet adjacent said cut leading end so as to hold-down said leading end portion against said support surface means for monitoring the movement of said veneer sheet in said given direction, means for shifting said holding means between said inoperative and operative positions, and control means connected to said monitor means and said shifting means for controlling the operation of the shifting means according to a position reached by said cut leading end of the veneer sheet which is detected by the monitor means.

2. A device according to claim 1, wherein said control means is operable on said shifting means in such a way that said holding means is shifted to its operative position before the cut leading end of the veneer sheet reaches the glue deposit and also that it is shifted away from the operative position only after the glue has been picked up by the cut leading end.

3. A device according to claim 2, wherein said holding means includes a freely rotatable roll having a peripheral surface for said pressing surface and shiftable between said inoperative position where said peripheral surface is placed away from said support surface and said operative position where it is placed in pressing contact with the veneer sheet adjacent said cut leading end against said support surface while allowing the veneer sheet to move forward past said roll.

4. A device according to claim 1, wherein said support member includes an endless belt provided in the form of a loop having at least one flat surface for said support surface, said endless support belt being rotatably movable intermittently along said line for glue deposit formation for at least a distance equal to the dimension of said flat surface as measured across said given direction.

5. A device according to claim 4, wherein said endless support belt has a drive operatively connected to said control means and operable in response to a signal therefrom for driving the support belt to move for said at least distance before the operation of said shifting means to shift said holding means to its operative position.

6. A device according to claim 5, wherein said glue feed means is provided adjacent the upstream end of said flat surface intermittently movable with said endless support belt and operable to feed the glue in conjunction with the movement of said support belt.

7. A device according to claim 6, wherein said endless support belt includes means for removing glue remaining on said flat surface.

8. A device according to claim 1, wherein said cut leading end is formed with a beveled surface having an inclination of a predetermined angle, said veneer sheet being fed with the beveled surface of said leading end thereof facing outward as seen from said support surface, and said device further comprising means disposed downstream of said holding means and having a glue spreading portion engageable with said support surface of the support member for spreading the glue picked up by the leading end over said beveled surface, said spreading means being shiftable between inoperative position thereof where said spreading portion is placed away from said support surface and operative position thereof where it is placed at least firstly in engagement with said support surface for spreading the glue over said beveled surface when said beveled surface moves past the glue spreading portion, and means for shifting said glue spreading means between said inoperative and operative positions.

9. A device according to claim 8, wherein said shifting means for shifting the glue spreading means is actuable so as to shift the spreading means to its operative position in conjunction with the actuation of said shifting means for said holding means to shift it to its operative position.

10. A device according to claim 8, wherein said glue spreading means is freely movable away from said support surface at least for a distance substantially equal to the thickness dimension of the veneer sheet and includes switch means actuable by the free movement of the glue spreading means for said at least distance, said shifting means for said holding means and glue spreading means being actuable in response to the actuation of said switch means to cause said glue spreading means and holding means to move to their inoperative positions, respectively.

11. A device according to claim 8, wherein said glue spreading means includes an intermittently rotatable belt made of a resiliently deformable material in the form of a loop having at least one straight flexible portion for said glue spreading portion engageable with said support surface.

* * * * *